United States Patent [19]

Chester

[11] Patent Number: 4,506,659

[45] Date of Patent: Mar. 26, 1985

[54] SCALP MASSAGER

[76] Inventor: Thomas M. Chester, 1719 Captain Shreve, Shreveport, La. 71105

[21] Appl. No.: 598,060

[22] Filed: Apr. 9, 1984

Related U.S. Application Data

[63] Continuation of Ser. No. 415,575, Sep. 7, 1982, abandoned.

[51] Int. Cl.[3] ..... A61H 7/00

[52] U.S. Cl. ..... 128/52; 128/59

[58] Field of Search ..... 128/44–55, 128/59–61, 62 R

[56] References Cited

U.S. PATENT DOCUMENTS 1,391,919 9/1921 Thompson ..... 128/59
1,712,764 5/1929 Hassler ..... 128/62 R
2,467,007 4/1949 Boyd ..... 128/52
2,856,918 10/1958 Kinery et al. ..... 128/64

*Primary Examiner*—Richard J. Apley
*Assistant Examiner*—David J. Brown
*Attorney, Agent, or Firm*—Vinson & Elkins

[57] ABSTRACT

A massaging device for the scalp includes a pair of massaging elements which frictionally engage the scalp and are reciprocated with respect to each other in a generally horizontal direction with respect to the head resulting in moving relatively large areas of the outer skin layer of the scalp with respect to the skull and also with respect to each other and thereby substantially duplicate the massaging action obtained with the usual hand massage to improve circulation in the scalp accomplish relaxation and stimulate hair growth.

11 Claims, 11 Drawing Figures

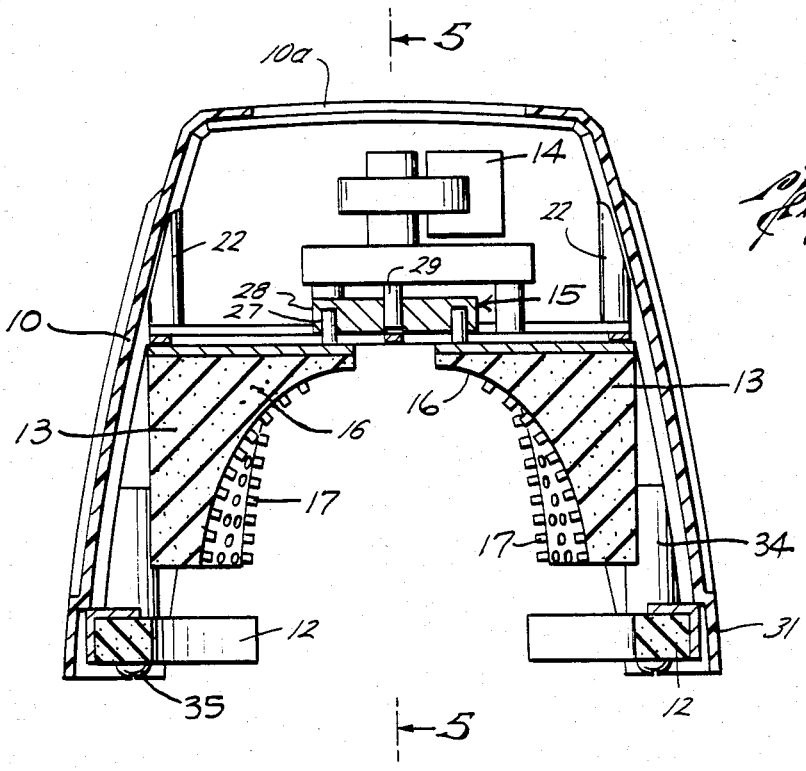
Fig. 4
Fig. 5
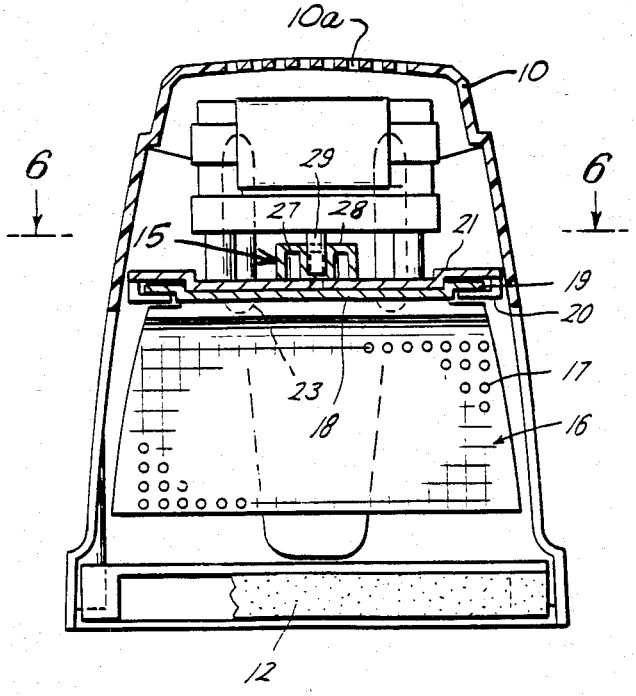
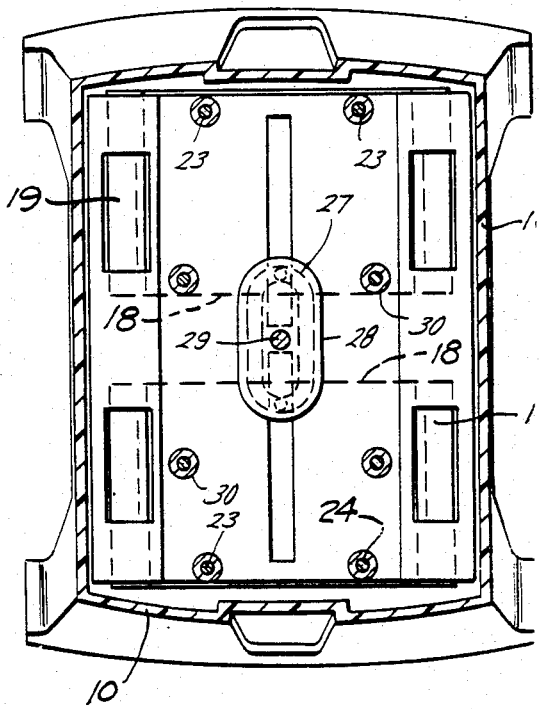
Fig. 6

27
28

10
33
20
24
26
26
21
30
24
20
23
20
34
31
10
12
33
35
19
25
19
18
17
13

31
12
32
31a

SCALP MASSAGER

This application is a continuation of applicant's patent application Ser. No. 415,575 filed Sept. 7, 1982, now abandoned.

This invention relates to new and useful improvements in a massage device for massaging the scalp.

BACKGROUND OF THE INVENTION

As is well known, the use of hand massaging of the scalp has been used to stimulate blood circulation which promotes scalp health and also has a relaxing effect. Additionally, such massaging has been found to stimulate hair growth. The usual hand massage is accomplished by placing the fingers of the hands on each side of the top of the head with the thumb of each hand engaging the side of the head just above one ear. Keeping the thumb of each hand relatively stationary, the fingers of each hand are moved toward and away from each other to cause the outer skin layer of the head to move relative to the skull. At the same time, the outer skin layer on the right side of the head is alternately moved back and forth with respect to that portion of said outer skin layer on the opposite or left side of the head. This type of massage has been found most effective in stimulating circulation in the scalp which promotes scalp health and relaxation as well as stimulating hair growth.

Many types of scalp treatment devices have been patented but none have been particularly successful with the possible exception of the hand vibrator which depends not on the vibrator but upon the hand of the person using such vibrator. Actually, a vibrator merely causes a vibration of relative small motion, so that it applies its vibratory action only to a very limited or localized area. It is impossible to impart any substantial movement of the outer skin layer with respect to the skull as is done with a hand massage. There are many types of vibrators in the prior art and examples of such types are shown in the patents to Merrill U.S. Pat. No. 1,974,031, Schamblin U.S. Pat. No. 3,481,326, Wojtowicz U.S. Pat. No. 3,720,204 and Okazaki et al U.S. Pat. No. 4,210,134. The patent to Schopfel U.S. Pat. No. 3,457,913 illustrates a scalp vibrator which applies vibration to various areas of the scalp but it makes no attempt to impart a lateral motion to large areas of the outer skin layer so as to move such large areas toward and away from each other relative to the skull and in a motion which duplicates the hand massage.

Other prior patents of some general interest are Avery U.S. Pat. No. 2,569,795, Heger U.S. Pat. No. 2,655,145, Avery U.S. Pat. No. 2,657,684 and Pitzen et al U.S. Pat. No. 3,872,850. However, none of these devices attempt to impart the "hand massage" motion to the outer skin layer of the scalp.

OBJECTS OF THE INVENTION

It is one object of this invention to provide an improved massage device for massaging the scalp having massage elements engaging the sides and top of the scalp in such a manner that when actuated, said elements move portions of the outer skin layer of the scalp relative to the skull to substantially duplicate a "hand massage".

Another object is to provide a hat-like body adapted to be supported upon the head and having a pair of massage elements formed to engage the head and mounted to move toward and away from each other to impart movement to relatively large areas of the outer skin layer of the scalp with respect to each other and to the skull of the head.

A further object is to control the motion of the massage elements by means of a cam and pin arrangement whereby the travel or path of said massage elements may be accurately defined with respect to the head of the person whose scalp is being massaged.

Another object is to provide improved massage elements constructed of a resilient material with each element having its inner surface contoured to conform to approximately one-half of the top, side and rear portions of the head thereby giving it a generally semi-circular or oval shape in cross-section. Each element also has an inner surface capable of frictionally engaging the scalp to assure movement of the outer skin layer of the scalp relative to the skull when the massage device is operating.

A particular object is to provide an improved clamping means within the hat-like body of the device for firmly mounting said body on the head of the person being treated.

Other objects and advantages of the present invention are hereinafter set forth and are explained in detail with reference to the drawings wherein:

BRIEF DESCRIPTION OF THE DRAWINGS

FIG. 4 is a view similar to FIG. 3 but showing the massaging elements in their laterally separated or outward position;

FIG. 5 is a vertical sectional view taken on the line 5—5 of FIG. 4;

FIG. 6 is a horizontal cross-sectional view taken on the line 6—6 of FIG. 5;

DESCRIPTION OF THE PREFERRED EMBODIMENT

Figure 1:
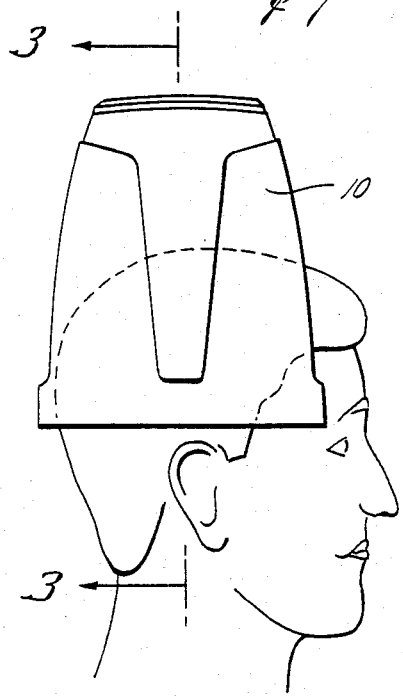
FIG. 1 is a side elevation of a massaging device, constructed in accordance with the invention, and illustrating the same mounted upon the head of a user.

In the drawings, the numeral 10 designates an outer housing which is shaped similarly to a hat or helmet so that it may fit the head of the user. The housing is constructed of plastic or other suitable material and has a recess 11 in its forward wall (FIG. 2) which facilitates placement of the housing upon the head. At the lower end of each side wall of the housing, an adjustable clamping cushion 12 is mounted so that when the housing is in place on the head, the cushions 12 engage the sides of the head just above the ears and maintain the housing in position. A pair of massaging elements 13 are mounted within the housing and are adapted to engage the crown and the sides of the head when the housing is in place. The massaging elements are movable by means of a suitable motor 14 which drives a cam assembly 15 to operate the massaging elements 13 in a desired manner. The upper end of the housing 10 is preferably open as indicated at 10*a*.

Figure 3:
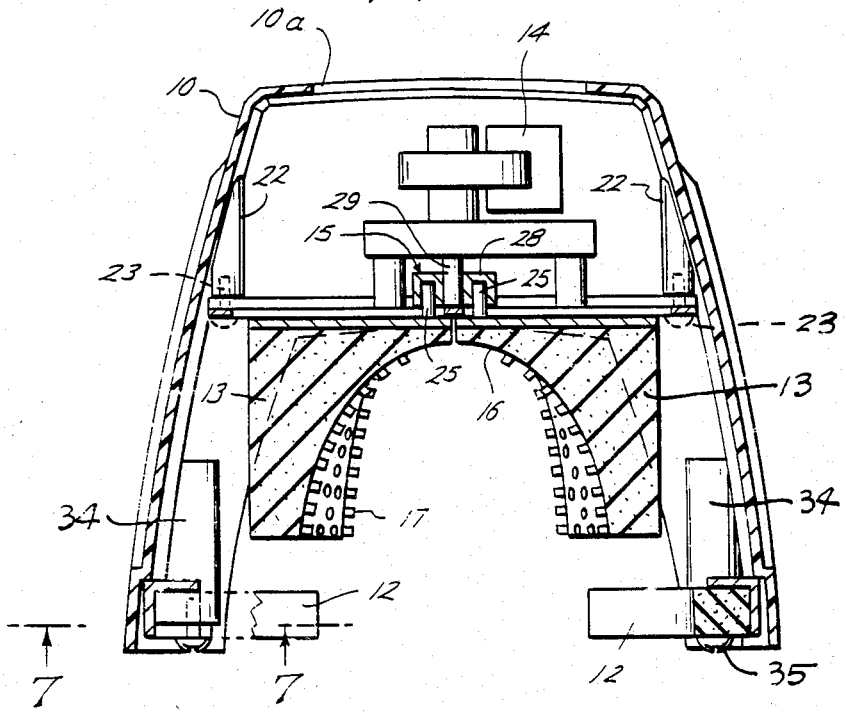
FIG. 3 is a vertical cross-sectional view taken through the approximate center and along the line 3—3 of FIG. 1 with the massaging elements in their inward position.

The massage elements 13 are an important feature of the present invention and are best shown in FIGS. 3, 4 and 5. Each element is constructed of a resilient or flexible material such as rubber and has an inner surface 16 which is generally contoured to fit approximately one-half of the top, side and rear portions of the head. The curvature of said inner surface is such that it engages the crown, sides and back portions of the head. The material has sufficient resilience or flexibility to assure a firm frictional contact with the head. Although not essential, it is desirable that this inner surface be provided with inwardly extending projections 17 which are also formed of a resilient or flexible material. When the elements 13 are in contact with the head of the user, the flexible projections 17 engage the outer layer of skin of the scalp with a relatively firm frictional contact. Thus, upon the massaging elements 13 being moved in the manner hereinafter described, the scalp will be massaged in a particular way which substantially duplicates the hand massage which is normally given to the scalp when a massager uses his hands in a treatment.

Figures 7, 8, 9, 10, 11:
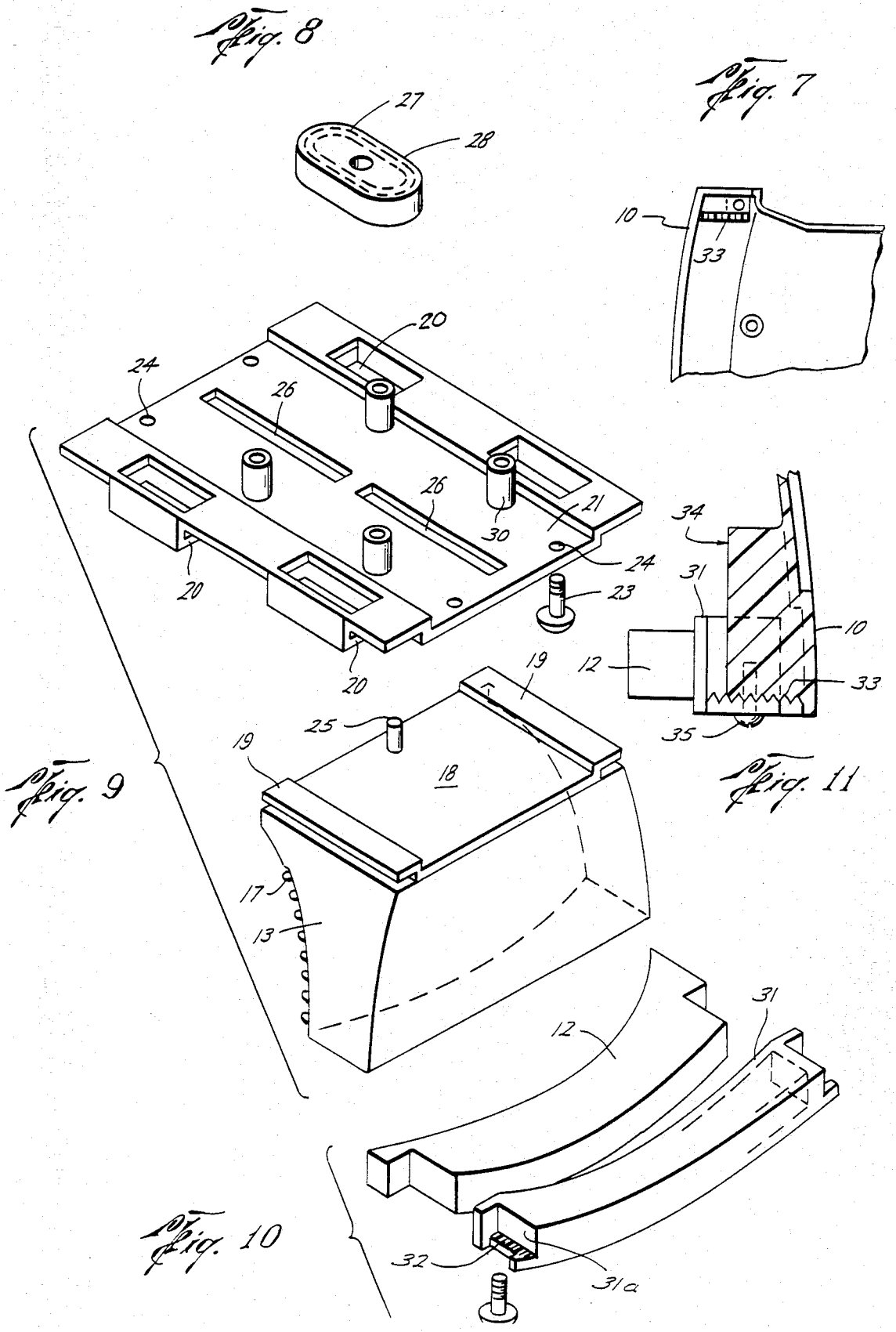
FIG. 7 is a partial cross-sectional view taken on the line 7—7 of FIG. 3.
FIG. 8 is an isometric view of the cam which imparts a reciprocating action to the massage elements.
FIG. 9 is an exploded view showing the support plate and one of the massage elements which are mounted to reciprocate on said plate.
FIG. 10 is an exploded view of one of the clamping cushions and its base member.
FIG. 11 is an enlarged sectional view showing the manner of adjusting the clamping cushions with respect to the head of the user.

For imparting the desired type of motion to the massage elements, each element is molded or otherwise secured to a slide plate 18 (FIGS. 5 and 9). The plate 18 is formed with parallel offset flanges 19 on each side thereof and such flanges are adapted to slide within retaining tracks 20 formed on the lower end of a support plate 21. The support plate 21 extends across the interior of the housing 10 and is secured to vertical posts 22 which are molded or otherwise secured to the inner surface of said housing. Suitable screws 23 pass upwardly through openings 24 formed in the support plate and thread into the support posts 22. The support posts are clearly shown in FIG. 4 and are partially shown in FIG. 5 with the screws 23 being indicated in dotted lines. With the support plate 21 secured in place extending across the interior of the housing, its depending retaining tracks 20 are engaged by the flanges 19 of each massage element 13 whereby each element may move laterally within the interior of the housing.

The cam assembly 15 imparts the desired movements to the two massage elements 13. For driving the slide plate of each element, each plate has an upstanding drive pin 25 (FIG. 9). The pins 25 of the two slide plates extend through elongate slots 26 formed in the support plate and may move longitudinally within said slots. The upper end of each drive pin 25 engages within a groove 27 formed in the drive cam 28 of the cam assembly 15 which is driven through shaft 29 by the motor 14. As clearly shown in FIGS. 6 and 8, the drive cam is a relatively long oval shape and the groove 27 within which drive pins 25 are engaged is of substantially the same oval shape. By reason of the shape of the cam, the massage elements 13 will be reciprocated laterally from the position shown in FIG. 3 to the position shown in FIG. 4. As shown in the drawings, the points of attachment where the massage elements 13 are moveably mounted with respect to the housing 10 move toward and away from each other in the same plane and along a straight line. With the elements engaged with the scalp, this lateral reciprocating motion will result in the top layers of the scalp being squeezed toward each other and then released in a back and forth motion. The speed of the motor is adjusted so that this reciprocating motion will substantially duplicate the actions of the fingers upon the scalp when a hand massage is being performed.

The motor 14 is suitably secured to upstanding posts 30 which are formed on the support plate 21 so that the motor and its associated cam assembly are carried by the single support plate which extends transversely across the interior of the housing. It might also be noted that the massage elements 13 are carried by the same support plate by reason of the flanges 19 having a sliding engagement with the retaining tracks 20 which depend from the support plate.

When the device is to be mounted on the users head, it is placed in position with the arcuate clamping cushions 12 having a snug engagement with the side of the head just above the ears. In order to permit an adjustment of each arcuate cushion, said cushion is disposed within a support or base member 31 (FIGS. 3, 4 and 10). Each base member has its ends recessed at 31*a* and within said recess an upwardly facing toothed or irregular surface 32 is formed. As more clearly shown in FIG. 11, the irregular toothed surface 32 is arranged to engage a downwardly facing complementary irregular surface 33 formed on the lower end of an enlarged portion 34 extending inwardly from the inner surface of the housing 10. By observing FIG. 11, it will be evident that the position of the support member 31 and the clamping cushion 12 which is carried thereby may be adjusted inwardly and outwardly with respect to the head. A suitable screw 35 threads into the lower surface of the enlarged portion 34 to maintain an adjusted position of the cushion.

Figure 2:
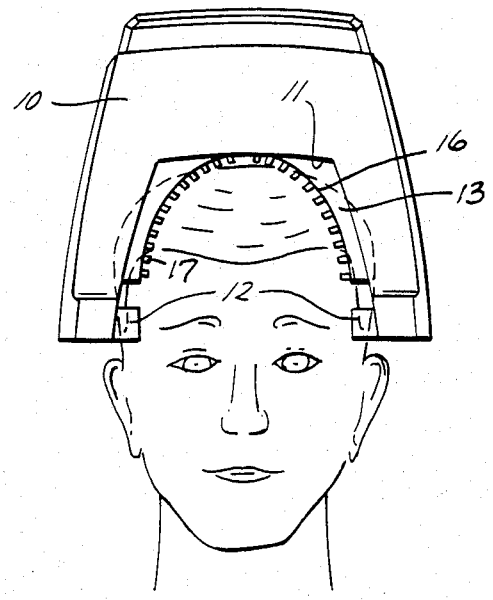
FIG. 2 is a front elevation of the device.

In the use of the device, the housing is placed upon the head in the manner shown in FIGS. 1 and 2 with the massage elements 13 having their inner surfaces 16 in firm engagement with the scalp. The projections 17 are relatively small and close together and form flexible gripping means for firmly engaging the outer layer of skin of the scalp. With the housing and its elements 13 in proper position with respect to the scalp, the side clamping cushions 12 are properly adjusted to maintain the device in proper position.

Upon operating the motor, the massage elements 13 will, by reason of the cam assembly 15, move in a lateral reciprocating motion. Such elements will move from the position of FIG. 3 to a spaced position as shown in FIG. 4. The gripping members 17 of the elements will, during movement of said elements, cause a movement of the outer skin layer of the scalp in a back and forth motion relative to the skull. There is substantially no vibration in the sense of the usual vibrator which has been used for massage purposes in the past but only a reciprocating movement of the massage elements toward and away from each other in a general horizontal plane with respect to the head.

As has been noted, it is desirable to form the inner surfaces of the massage elements in what could be termed a portion of an oval so as to properly engage the head. When the elements 13 are in the position of FIG. 3, the outer layers of the skin of the scalp should be somewhat squeezed toward the center or crown of the head. As the elements move away from each other to the position of FIG. 4, there is a stretching action imparted to the skin layers and by adjusting the speed of the motor, it is possible to substantially duplicate the hand action which is applied to the scalp by a hand massage. It has been found that the reciprocating action or the lateral back and forth movement is very effective in providing a massage of the head which not only stimulates blood circulation in the scalp but also encourages hair growth.

What is claimed is:

1. A massage device for massaging the scalp including, a housing adapted to be positioned on the head of a user, a pair of massaging elements mounted within the housing, each massaging element having an internal curved surface adapted to engage a substantially large area of one side portion and part of the top of the head when the housing is in position, means for mounting said massaging elements for reciprocating movement toward and away from each other within the housing and with respect to the scalp, wherein the points of attachment where said massaging elements are movably mounted with respect to the housing move toward and away from each other in the same horizontal plane and along a straight line, said massaging elements being of such size that when each is in its inward position the massaging elements co-act to substantially cover the top of the head, and means for reciprocating said massaging elements toward and away from each other whereby such motion of said massaging elements shifts the areas of the scalp in contact with the massaging elements toward and away from each other to thereby massage the scalp.

2. A message device as set forth in claim 1, together with means on the internal curved surface of each of said massaging elements for frictionally engaging the outer skin of the scalp.

3. A massage device as set forth in claim 1, together with arcuate shaped clamping members within the housing and located to engage the sides of the head above the ears to clamp and retain the housing in position on the head during the reciprocation of the massaging elements.

4. A massage device as set forth in claim 1, together with arcuate shaped clamping members within the housing and located to engage the sides of the head above the ears to clamp and retain the housing in position on the head, and means mounting said clamping members for adjustment to obtain the proper clamping members for adjustment to obtain the proper clamping action on heads of different sizes.

5. A massage device as set forth in claim 1, wherein the means for reciprocating said elements comprises, an electric motor mounted with the upper portion of the housing and above the massaging elements, a cam having an endless groove therein secured to the shaft of said motor, and rotatable by said motor, a drive pin secured to each massaging element and engaged within said cam groove, and guide means between the cam ad each element through which its drive pin extends for restricting the movement of each massaging element to a straight line reciprocating motion.

6. A massage device as set forth in claim 5, together with adjustable clamping means within the housing for clamping the housing in position on the head to locate the massaging elements in firm contact with the scalp.

7. A massage device for massaging the scalp including, a housing adapted to be positioned on the head of a user, a pair of massaging elements formed of resilient material mounted totally within the housing and mounted for reciprocating movement toward and away from each other within the housing and with respect to the scalp, wherein the points of attachment where said massaging elements are movably mounted with respect to the housing move toward and away from each other in the same horizontal plane and along a straight line disposed transversely across the upper portion of the head, each massaging element having an internal curved surface frictionally engaging the outer skin layer of the scalp, and means within the housing for reciprocating said massaging elements toward and away from each other to thereby move those portions of the outer skin layer of the upper portion of the scalp which are engaged by said massaging elements toward and away from each other to perform a massaging action which simulates a hand massage.

8. A massage device as set forth in claim 7, together with means within the housing for clamping the housing in position on the head to properly locate the massaging elements in desired contact with the head.

9. A massage device for massaging the scalp including, a housing adapted to be positioned on the head of a user, a support plate extending across the interior of the housing and disposed above the user's head when the housing is in position, a pair of massaging elements within the housing below said support plate, each massaging element having a lower curved surface adapted to engage the area of one side portion and part of the top of the head when the housing is in position, a slide plate secured to the upper surface of each massaging element and slidably suspended from the support plate, whereby each massaging element is movable relative to said support plate, means on each slide plate co-acting with the support plate to guide and limit the slidable movement of each massaging element to reciprocal movement in the same horizontal plane whereby the elements may move toward and away from each other and with respect to the scalp, and means within the housing mounted on said support plate for reciprocating said elements in said reciprocal movement in said plane toward and away from each other whereby such motion of the massaging elements shifts those areas of the scalp in contact with said massaging elements toward and away from each other.

10. A massage device as set forth in claim 9, wherein the means on each slide plate co-acting with the support plate to guide and limit the slidable movement of each massaging element comprises a slot in said support plate and, a pin secured to the slide plate of its massaging element.

11. A massage device as set forth in claim 10, wherein the means for reciprocating the massaging elements comprises, an electric motor mounted within the upper portion of the housing above the support plate, a cam having an endless groove therein secured to the motor shaft and rotatable by said motor, said cam groove being engaged by each pin of each slide plate whereby rotation of said cam imparts movement to said massaging elements.

* * * * *